US006765467B2

(12) United States Patent
Ngo et al.

(10) Patent No.: US 6,765,467 B2
(45) Date of Patent: Jul. 20, 2004

(54) CORE SUPPORT ASSEMBLY FOR LARGE WOUND TRANSFORMER CORES

(76) Inventors: Dung A. Ngo, 27 Eastbrook Rd., Parsippany, NJ (US) 07054; Donald Christian Pruess, 96 Hillcrest Ave., Morristown, NJ (US) 07960; Kimberly M. Borgmeier, 195 College Farm Rd., Waltham, MA (US) 02451

( * ) Notice: Subject to any disclaimer, the term of this patent is extended or adjusted under 35 U.S.C. 154(b) by 204 days.

(21) Appl. No.: 09/841,945

(22) Filed: Apr. 25, 2001

(65) Prior Publication Data

US 2002/0157239 A1 Oct. 31, 2002

(51) Int. Cl.[7] ..... H01F 27/06

(52) U.S. Cl. ..... 336/67; 336/65; 336/214; 336/234; 336/213

(58) Field of Search ..... 336/67, 65, 213, 336/214, 234, 68

(56) References Cited

U.S. PATENT DOCUMENTS

| | | | | |
|---|---|---|---|---|
| 3,153,216 A | | 10/1964 | Klitten | |
| 3,212,172 A | | 10/1965 | Davis | |
| 3,233,311 A | | 2/1966 | Giegerich et al. | |
| 3,434,087 A | | 3/1969 | Hofmann | |
| 3,548,355 A | | 12/1970 | Martincic et al. | |
| 3,611,226 A | | 10/1971 | Cotton et al. | |
| 3,626,587 A | | 12/1971 | Zickar et al. | |
| 3,708,897 A | | 1/1973 | Martincic et al. | |
| 3,750,071 A | | 7/1973 | Eley | |
| 3,774,298 A | | 11/1973 | Eley | |
| 4,438,421 A | * | 3/1984 | Leach, Jr. | 336/65 |
| 4,504,813 A | | 3/1985 | Strang | |
| 4,599,594 A | * | 7/1986 | Siman | 336/92 |
| 4,751,488 A | | 6/1988 | Lanoue et al. | |
| 4,766,407 A | * | 8/1988 | Grimes | 336/196 |
| 5,242,760 A | | 9/1993 | Matsuoka et al. | |
| 5,319,341 A | * | 6/1994 | Bisbee et al. | 336/67 |
| 5,455,392 A | | 10/1995 | Preu et al. | |
| 5,470,646 A | | 11/1995 | Okamura et al. | |
| 5,608,371 A | * | 3/1997 | Valencic et al. | 336/210 |

FOREIGN PATENT DOCUMENTS

| | | |
|---|---|---|
| EP | 0 082 954 A1 | 7/1983 |
| FR | 2 289 039 | 5/1976 |
| GB | 1087594 | 10/1967 |
| GB | 1156369 | 6/1969 |

OTHER PUBLICATIONS

Copy of PCT Search Report for PCT/US99/06476 dated Jul. 9, 1999.

Copy of PTO Form 892 from U.S. Ser. No. 09/276,164.

Patent Abstract of Japan Publication No. JP 58–141515 A.

Patent Abstract of Japan Publication No. 59–121810 A2.

Report titled: "National Appliance and Equipment Energy Efficiency Program, Anaysis of Potential for Minimum Energy Performance Standards for Distribution transformers", Draft Final Repot dated May 3, 2000 by ark Ellis & Associates, 44, Albert Street, Wagstaffe, NSW 2257, Australia.

* cited by examiner

*Primary Examiner*—Anh Mai
(74) *Attorney, Agent, or Firm*—Ernest D. Buff & Associates, LLC; Ernest D. Buff; Gordon E. Fish

(57) ABSTRACT

Transformer cores, especially those of wound or laminated annealed amorphous metals which include support assemblies are disclosed. Methods for their manufacture, and their use in assembled transformers are also disclosed.

6 Claims, 4 Drawing Sheets

CORE SUPPORT ASSEMBLY FOR LARGE WOUND TRANSFORMER CORES

FIELD OF THE INVENTION

The present invention relates to transformer cores. More particularly to transformer cores made from strip or ribbon composed of ferromagnetic material, especially amorphous metal alloys.

BACKGROUND OF THE INVENTION

Transformers conventionally used in distribution, industrial, power, and dry-type applications are typically of the wound or stack-core variety. Wound core transformers are generally utilized in high volume applications, such as distribution transformers, since the wound core design is conducive to automated, mass production manufacturing techniques. Equipment has been developed to wind a ferromagnetic core strip around and through the window of a pre-formed, multiple turns coil to produce a core and coil assembly. However, the most common manufacturing procedure involves winding or stacking the core independently of the pre-formed coils with which the core will ultimately be linked. The latter arrangement requires that the core be formed with one joint for wound core and multiple joints for stack core. Core laminations are separated at those joints to open the core, thereby permitting its insertion into the coil window(s). The core is then closed to remake the joint. This procedure is commonly referred to as "lacing" the core with a coil.

A typical process for manufacturing a wound core composed of amorphous metal consists of the following steps: ribbon winding, lamination cutting, lamination stacking, strip wrapping, annealing, and core edge finishing. The amorphous metal core manufacturing process, including ribbon winding, lamination cutting, lamination stacking, and strip wrapping is described in U.S. Pat. Nos. 5,285,565; 5,327,806; 5,063,654; 5,528,817; 5,329,270; and 5,155,899.

A finished core typically has a rectangular shape with the joint window in one end yoke. The core legs are rigid and the joint can be opened for coil insertion. Amorphous laminations have a thinness of about 0.025 mm. This causes the core manufacturing process of wound amorphous metal cores to be relatively complex, as compared with manufacture of cores wound from transformer steel material composed of cold rolled grain oriented (SiFe). The consistency in quality of the process used to form the core from its annulus shape into rectangular shape is greatly dependent on the amorphous metal lamination stack factor, since the joint overlaps need to match properly from one end of the lamination stack factor, since the joint overlaps need to match properly from one end of the lamination to the other end in the 'stair-step' fashion. If the core forming process is not carried out properly, the core can be over-stressed in the core leg and corner sections during the strip wrapping and core forming processes which will negatively affect the core loss and exciting power properties of the finished core. Core-coil configurations conventionally used in single phase amorphous metal transformers are: core type, comprising one core, two core limbs, and two coils; shell type, comprising two cores, three core limbs, and one coil. Three phase amorphous metal transformer, generally use core-coil configurations of the following types: four cores, five core limbs, and three coils; three cores, three core limbs, and three coils. In each of these configurations, the cores have to be assembled together to align the limbs and ensure that the coils can be inserted with proper clearances. Depending on the size of the transformer, a matrix of multiple cores of the same sizes can be assembled together for larger kVA sizes. The alignment process of the cores' limbs for coil insertion can be relatively complex. Furthermore, in aligning the multiple core limbs, the procedure utilized exerts additional stress on the cores as each core limb is flexed and bent into position. This additional stress tends to increase the core loss resulting in the completed transformer.

The core lamination is brittle from the annealing process and requires extra care, time, and special equipment to open and close the core joints in the transformer assembly process. Lamination breakage and flaking is not readily avoidable during this process opening and closing the core joint. Containment methods are required to ensure that the broken flakes do not enter into the coils and create potential short circuit conditions. Stresses induced on the laminations during opening and closing of the core joints oftentimes causes a permanent increase of the core loss and exciting power in the completed transformer. These technical concerns are particularly relevant wherein large annealed wound amorphous metal transformer cores, such as those used in large power transformers (typically distinguished as having a duty rating of at least 500 KVA) are to be produced. The mass of such transformer cores very often deleteriously affects the handling of large annealed wound amorphous metal transformer cores during the assembly process of both the core itself, as well as of the transformer in which the core is utilized. Further the mass of such transformer cores also frequently compounds the likelihood of flaking, cracking or breaking of the embrittled annealed amorphous metal cores which leads to increased potential for greater core losses in the finally assembled transformer. In such applications operating efficiency is of paramount importance and such cracks or breaks in the annealed amorphous metal decreases the operating efficiency of the core. Flaking, wherein pieces of the core are broken and separated, usually find themselves trapped in between the laminar layers of the wound core and decrease stacking efficacy, as well as raise the likelihood of causing electrical short circuits. This too results in core losses and decreased operating efficacy. Flaking is also deleterious when the core is to be used in a fluid filled, i.e., oil filled transformer. In addition to the likelihood of core losses due to decreased stacking efficacy, the loose flakes which may be present in the fluid also lower the dielectric strength of the liquid and also reduce the operating efficacy of the core.

A further inherent limitation of such annealed wound amorphous metal transformer cores is that when they are oriented in a vertical position, as is typical in most transformer designs, the mass of such annealed wound amorphous metal transformer cores may crack under its own weight. While weight distribution of annealed wound amorphous metal transformer cores is more evenly distributed amongst laminar layers when in a horizontal position, once uprighted and oriented vertically the "sagging" of the annealed wound amorphous metal transformer cores may cause cracking.

Accordingly there exists a real and present need for improvements to annealed wound amorphous metal transformer cores and assemblies which address and overcome one or more of these shortcomings.

It is to these and other shortcomings that the present invention is directed.

SUMMARY OF THE INVENTION

Figure 1:
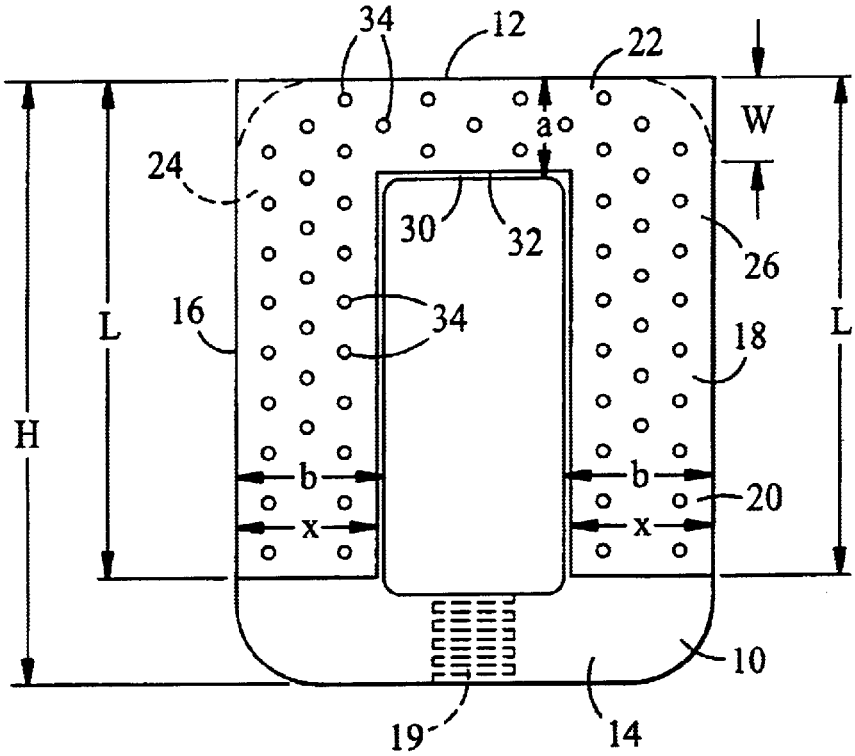
FIG. 1 depicts a side view of a wound metal transformer core which includes a first embodiment of a support assembly according to the invention.

According to one aspect of the invention, there is provided a support assembly which is adapted to be utilized with multi-limbed wound or laminated metal transformer cores, particularly, annealed multi-limbed amorphous metal transformer cores.

A further aspect of the invention a support assembly which is adapted to be utilized with multi-limbed wound or laminated metal transformer cores, particularly wherein annealed multi-limbed amorphous metal transformer cores wherein said cores has a mass of at least 200 kilograms but preferably having a mass of at least 500 kilograms.

In a further aspect of the invention, there is provided a transformer comprising a wound or laminated metal transformer core which includes a support assembly.

In a still further aspect of the invention there is provided a process for the manufacture of a multi-limbed metal transformer cores, particularly, wound and very particularly wound, annealed multi-limbed amorphous metal transformer cores, which cores include a support assembly.

In a further aspect of the invention there is provided a process for the manufacture of transformers which comprise a multi-limbed metal transformer core, particularly, wound and very particularly wound and annealed multi-limbed amorphous metal transformer cores, which cores include a support assembly.

In a yet further aspect of the invention, there is provided a transformer having a duty rating of at least 500 KVA which transformer comprises a multi-limbed wound metal transformer core, particularly an annealed multi-limbed amorphous metal transformer core, which core includes a support assembly.

These and other aspects of the invention will become apparent from a reading of the following specification.

DETAILED DESCRIPTION AND PREFERRED EMBODIMENTS

According to an aspect of the invention, there is provided a support assembly which is particularly dimensioned and adapted to simultaneously support at least two intersecting sections of an metal transformer core, particularly when the transformer core is wound or stacked, and especially particularly where the metal transformer core is an annealed amorphous metal transformer core. According to one preferred aspect of the invention, the support assembly includes at least two sections, a top section and at least one dependent leg section which is frequently generally perpendicular to the top section. The top section is adapted to be affixed to at least one portion of a wound metal transformer core, and the at least one dependent leg section is adapted to be affixed to at least a further portion of said transformer core.

In a further aspect of the invention, there is provided a support assembly adapted to be utilized with a wound metal transformer core, especially an annealed amorphous metal transformer core, said support assembly having at least a least three sections; a top section and at least two dependent leg section, said leg sections being both generally perpendicular to the top section, and generally parallel to one another. According to a further particularly preferred aspect of the invention, the top section is adapted to be affixed to at least one portion of a wound metal transformer core, one dependent leg section is adapted to be affixed to at least a further portion of said transformer core, usually a first leg of the wound metal transformer core, and the other dependent leg section is adapted to be affixed to at least a further portion of said transformer core, usually a second leg of the wound metal transformer core.

In a yet further aspect of the invention, there is provided a support assembly adapted to be utilized with a wound metal transformer core, especially an annealed amorphous metal transformer core, said support assembly having a top section and a plurality of dependent leg sections, said leg sections being both generally perpendicular to the top section, and generally parallel to one another. According to a further particularly preferred aspect of the invention, the top section is adapted to be affixed to at least one portion of one or more wound metal transformer cores, and each of the dependent leg sections are adapted to be affixed to further portions of said one or more wound metal transformer cores. Such an embodiment includes by way of non-limiting examples, multi-limbed metal transformer cores which include a plurality of cores.

Turning now to FIG. 1, therein is illustrated in a side view a wound metal transformer core 10 which includes a first embodiment of a support assembly 20 according to the invention.

As is seen from the side view depicted on the drawing, the core 10 includes a top portion 12, a bottom portion 14 and two legs 16, 18 extending therebetween which are generally parallel to each other. The core also includes a joint 19 which is depicted by dotted line; this joint is the location at which the core 10 can be unlaced, and opened in order to permit the installation of appropriately dimensioned transformer coils upon each of the legs 16, 18. It is also to be understood that while only a single joint 19 has been depicted, that a plurality of joints may also likewise be present in the transformer core 10. With regard now to the support assembly 20, as can be seen, the support assembly includes a top portion 22 as well as two dependent leg portions 24 and 26. As can be seen from an inspection of FIG. 1, the two dependent leg portions 24, 26 depend downwardly from one side of the top portion 22 of the support assembly 20. As further can be understood from a review of FIG. 1, the dimensions of the various portions of the support assembly 20 may be established in view of the dimensions of the core 10. For example, the width of the top portion 22 (as represented by "w") is desirably greater than or equal to the width (represented by "a") of the top portion 12 of the coil 10. With respect to the leg sections 24, 26 of the support assembly 20, their widths (represented by "x") are preferably less than or equal to the width (as represented by "b") of the leg 16, 18 of the transformer core 10. As can be further seen from FIG. 1, the overall length (as represented by "L") of the legs of the dependent leg sections 24, 26 is preferably less than the overall total height of the coil 10 (represented by "H").

A further technical consideration relates to the overall mass of the transformer core 10 which is used in conjunction with the support assembly 20. Generally, better results are obtained by maximizing the length of the leg sections 24, 26 of the support assembly 20, as such has been found to greatly facilitate in the reduction of the stresses in the transformer core 10 particularly when the transformer core is formed of an annealed, amorphous metal alloy. This is due to the observation that improved weight distribution occurs when the leg sections 24, 26 are maximized. Of course shorter lengths of the leg section may also be satisfactory with certain transformer configurations. Another technical consideration which relates to the respective widths of the top section 22 as well as the legs 24, 26 is that the corresponding sections of the support assembly 20 aid in protecting the wound transformer core. This is particularly relevant wherein the wound transformer core is formed of am embrittled, annealed amorphous metal alloy.

According to one preferred embodiment, as can be seen at FIG. 1, the support assembly 20 and in particular the top section 22 has a margin 30 is positioned slightly upwardly from the inner surface 32 of the top section 12 of the coil 10. This ensures that the margin 30 does not coincide with the dimensions of the core 10, 50 that when it is ultimately assembled with a pair of transformer coils the inner surface 32 rests on corresponding surfaces of the transformer coils (not shown in FIG. 1). In an alternate preferred embodiment which however differs slightly from the embodiment shown in FIG. 1, the top section 22 of the support assembly 20 has a margin 30 which is positioned slightly downwardly from the inner surface 32 of the top section 22 of the core 10. This creates a recess between the margin 30 and the inner face of the top section 12 of the core 10 which is particularly advantageous when the core 10 is ultimately placed in an upright position and the margin 30 rests upon the top surfaces 40 of one or more transformer coils 36, 38. When in such a configuration, it can then be seen that the load and stresses are borne greatly by the support assembly 20, and stresses in the wound transformer core 10 are reduced as compared with many prior art transformer coil and core configurations which do not include a support assembly as taught herein.

Further depicted on FIG. 1 are a plurality of passages passing through the support assembly 20. While shown to be generally circular in configuration, these passages 34, however, can take any other configuration and indeed do not necessarily need to pass completely through the support assembly 20. Indeed, it is contemplated that these can be wholly dispensed with and the support assembly 20 can have a smooth, uninterrupted surface. However, it is usually advantageous to ensure that an irregular surface of the support assembly 20 facing the wound transformer core 10 is present. Such irregularities, or passages passing through the support assembly 20 typically greatly facilitate the bond between the transformer core 10 and the support assembly 20 when an adhesive interposed therebetween.

While not illustrated in FIG. 1, it is contemplated that a similar support assembly 20 is also placed at the opposite face of the transformer core 10 (which, however, would not be visible from the perspective of FIG. 1). Typically, the use of two supports 20 having interposed therebetween the transformer core 10 is greatly to be preferred over the use of a single support assembly 20 which is affixed to only one side of a transformer core 10. The use of two (or more) supports 20 acts to further distribute any stresses more evenly than would be achieved otherwise.

Figure 2:
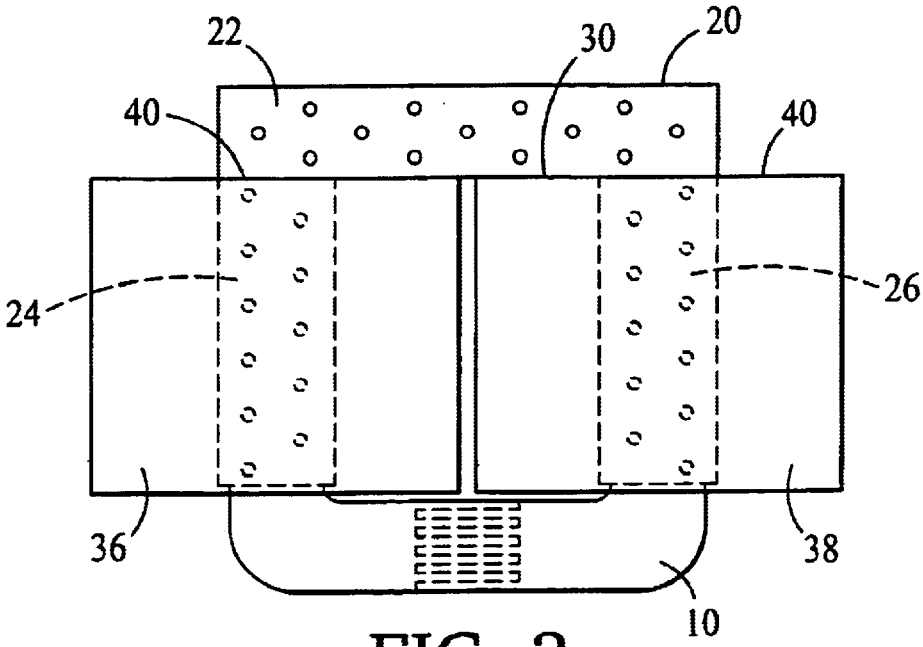
FIG. 2 illustrates a side view of the wound metal transformer core and support assembly according to FIG. 1, as well as further depicting two transformer coils.

With respect now to FIG. 2, therein is illustrated a side view of the wound metal transformer core 10 and support assembly 20 according to FIG. 1, and further depicts two transformer coils 36, 38.

As can be further seen from FIG. 2, in the assembled transformer depicted on that figure, the transformer coils 36, 38 include passages which are suitably dimensioned to permit for their insertion upon the respective legs 16, 18 of the transformer core 10. Likewise, attention is directed to interface between the top surfaces 40 of the respective coils 36, 38 and the top section 22 of the support assembly 20. As can be seen, the margin 30 of the top section 22 of the support assembly 20 is seen to rest upon the top surface 40 of the coils 36, 38.

Figure 3:
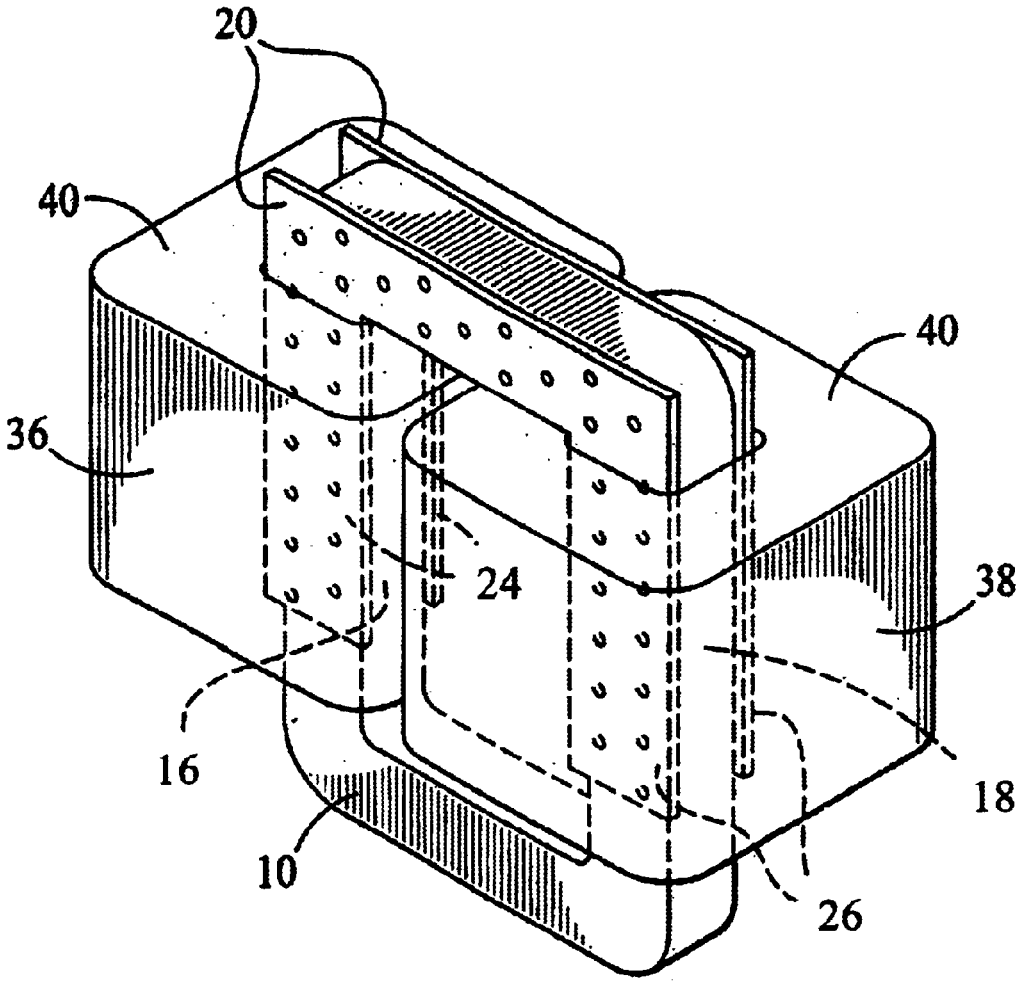
FIG. 3. depicts a perspective view of the wound metal transformer core and support assembly according to FIGS. 1 and 2.

Turning to FIG. 3, there is depicted a perspective view of the wound metal transformer core and core support assembly according to FIGS. 1 and 2.

As can be seen from the perspective view, the complete width of the margin 30 is seen to rest upon the generally flat, and coplanar faces 40 of the coils 36, 38. This is particularly beneficial in reducing the stresses imparted within the wound transformer core. As can also be understood from a view of FIG. 3, it will be appreciated that when the transformer is ultimately assembled and positioned in an upright position, such as shown in FIG. 3, the leg sections 24, 26 of each of the supports which are affixed to the respective legs 16, 18 of the core 10 distributes the vertical load and facilitates in the dissipation of stresses within the core 10 by suspension.

Figure 4:
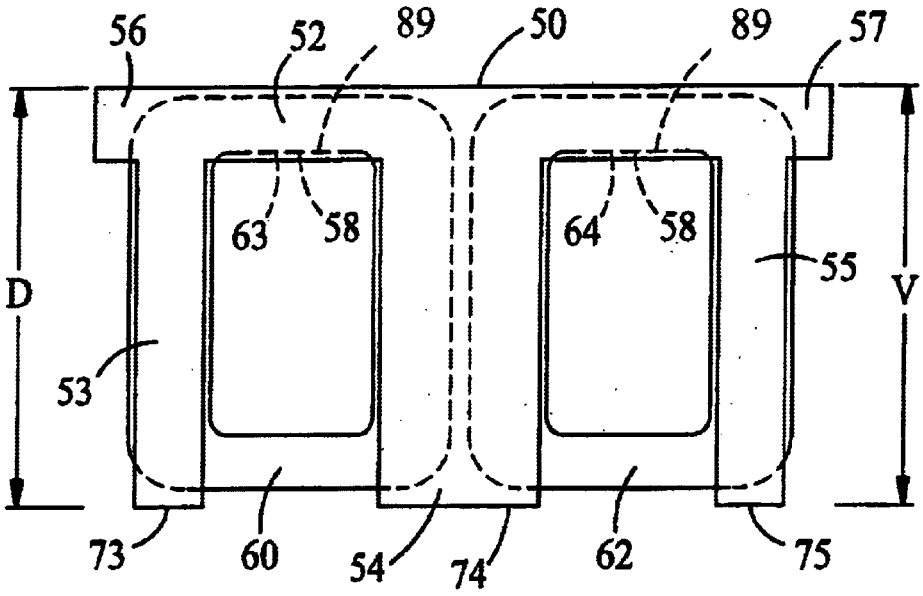
FIG. 4 illustrates a side view of a second embodiment of the support assembly according to the invention used in conjunction with two wound metal transformer cores.

With regard to FIG. 4, therein is depicted a side view of a second embodiment of a support assembly 50 according to the invention used in conjunction with two wound metal transformer cores 60, 62.

Therein, the support assembly 50 includes a top section 52 as well as three downwardly depending leg sections 53, 54 and 55. Additionally, the top section 52 includes two extended ends 56, 57. With regard now to the relative dimensions of the support assembly 50, as can be readily seen from FIG. 4, the overall height (as represented by "D") of the support assembly 50 is at least as great as the height (as represented by "v") of the two coils 60, 62. Similarly, the respective widths of the dependent leg sections 53 and 55 are lesser than the width of the corresponding core legs which they face. Similarly the width of the dependent leg section 54 is lesser than the combined width of the abutting core legs of cores 60, 62 which the dependent leg section 54 faces. According to the preferred embodiment depicted on FIG. 4 the dimensions of the dependent leg sections 53, 54 and 55 are lesser than the widths of the corresponding core legs which they face. Additionally, and distinguishable from the support assembly 20 of FIG. 1, is the overall height of the support assembly 50. Unlike the shorter height of the support assembly 20 in FIG. 1, the lengths of each of the dependent leg sections 53, 54, 55 is equal to or greater than, but is desirably greater than, the height of each of the cores 60, 62. Again, the technical considerations regarding the selection of such a height lies in the fact that when the core 60, 62 are uprighted into a vertical position, stresses imparted within each of the respective cores 60, 62 can be substantially reduced and even minimized due to the fact that the mass of the respective cores 60, 62 rests on the bottom "feet" 73, 74, 75 of the respective dependent leg sections 53, 54, 55. Additionally, the greater lengths of the respective leg sections 53, 54, 55 provide a greater respective surface area ratio of the support assembly 20 to the surface area of the sides of the respective transformer cores 60, 62. When adhered or affixed together, such an increased surface area ratio acts to enhance the distribution of stresses in the core so to minimize undesirable stresses as well as consequent core losses.

As can be also seen in FIG. 4, the support assembly 50 in this embodiment does not include perforations passing therethrough, such as the perforations 34 of FIG. 1. It is also to be understood that although not shown in FIG. 4 that a similar support assembly 50 is present on the opposite side of the cores 60, 62 and supplies a reinforcing support to the opposite side of the cores 60, 62.

Figure 5:
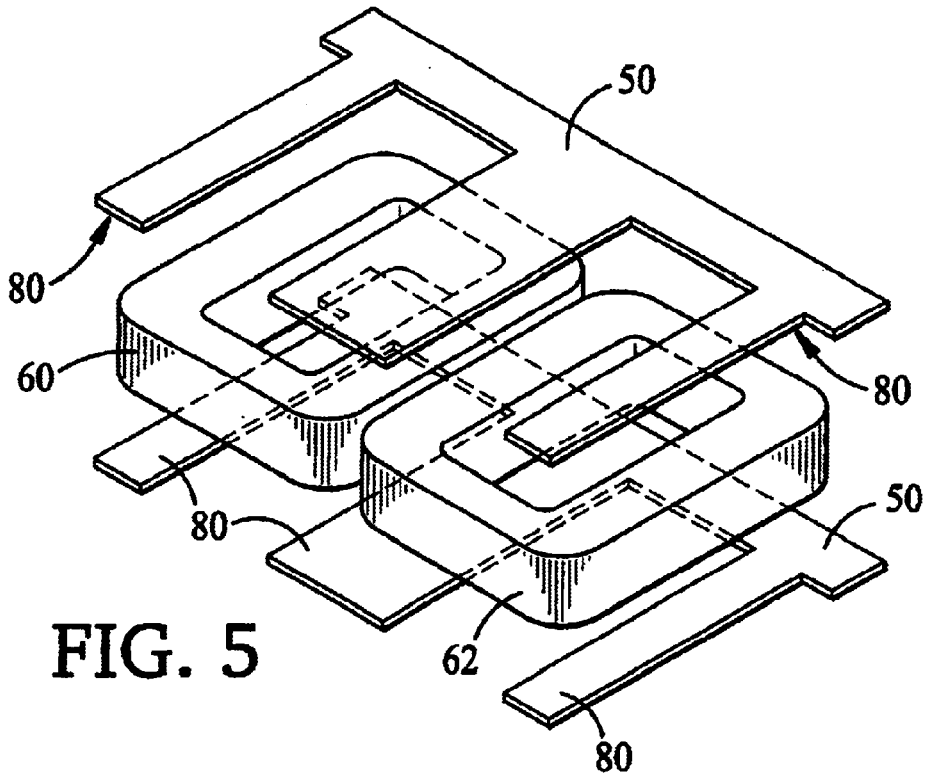
FIG. 5 depicts a perspective, exploded view of the second embodiment of the support assembly and two wound metal transformer cores according to FIG. 4.

FIG. 5 depicts a perspective, exploded view of the second embodiment of the support assembly 50 and two wound metal transformer cores 60, 62 according to FIG. 4. As can be seen more clearly in this exploded view, two supports assemblies 50 are actually present and are positioned on opposite sides of the transformer cores 60, 62. It is to be understood that prior to assembly, an appropriate adhesive such as an epoxy resin is disposed on the facing surfaces of the transformer cores 60, 62 and the supports 50. Thereafter, the supports 50 and transformer cores 60, 62 are layered in register and aligned, most desirably in accordance with the representation depicted on FIG. 4. Again, it is highly desirable, although not always absolutely necessary that a recess 89 exists between the inner face 63, 64 and the margin 58 of the top section 52 of the support assembly 50. Again, the presence of such a margin is believed to facilitate in the distribution of the vertical load between the support assembly 50 and the top faces of appropriate dimensioned transformer cores. Additionally, the extended ends 56, 57 also aid in facilitating the distribution of the vertical load when the cores 60, 62 and the support assembly 50 are ultimately assembled in a transformer.

Figure 6:
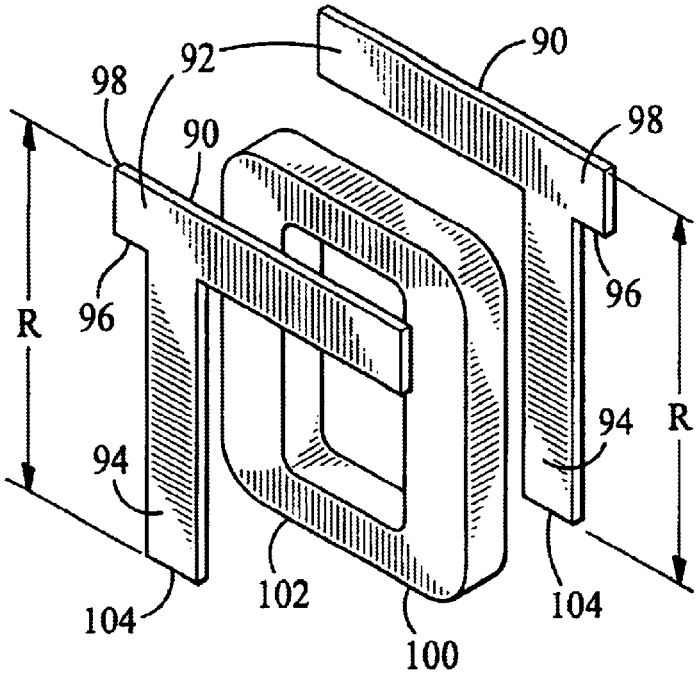
FIG. 6 depicts an exploded view of a third embodiment of a support assembly and a wound metal transformer core according to the invention.

FIG. 6 depicts an exploded view of a further embodiment of the invention. According to this embodiment, there are provided two supports 90 which are positioned at opposite faces of a wound transformer core 100. With regard to each of these supports 90, each includes a top portion 92 and has dependent therefrom and extended in a downwardly extending direction one leg 94. As can be seen from FIG. 6, unlike the supports depicted in FIGS. 1–5 which exhibited a general symmetry about an hypothetical center line bisecting the top sections of said aforesaid supports, in contrast, the supports 90 are non-symmetrical about such an hypothetical center line, but the supports 90 each have one downwardly depending leg 94 proximate towards one end 96 of the top sections 92. Further, in the embodiment depicted in FIG. 6, each of the supports 90 further include an extended end 98 which is expected to further facilitate the placement and load bearing characteristics of the assembled transformer core 100 and supports 90. Additionally, the overall heights (represented by "R") of the supports 90 are greater than the height of the transformer core 100 with which it will be used. As can still be further seen from the figure, the dependent legs 94 extend downwardly and extend beneath the bottom 102 of the coils and terminate in a "foot" 104 which is adapted to be placed upon a supporting surface when the transformer core 100 and the supports 90 are ultimately assembled.

Figure 7:
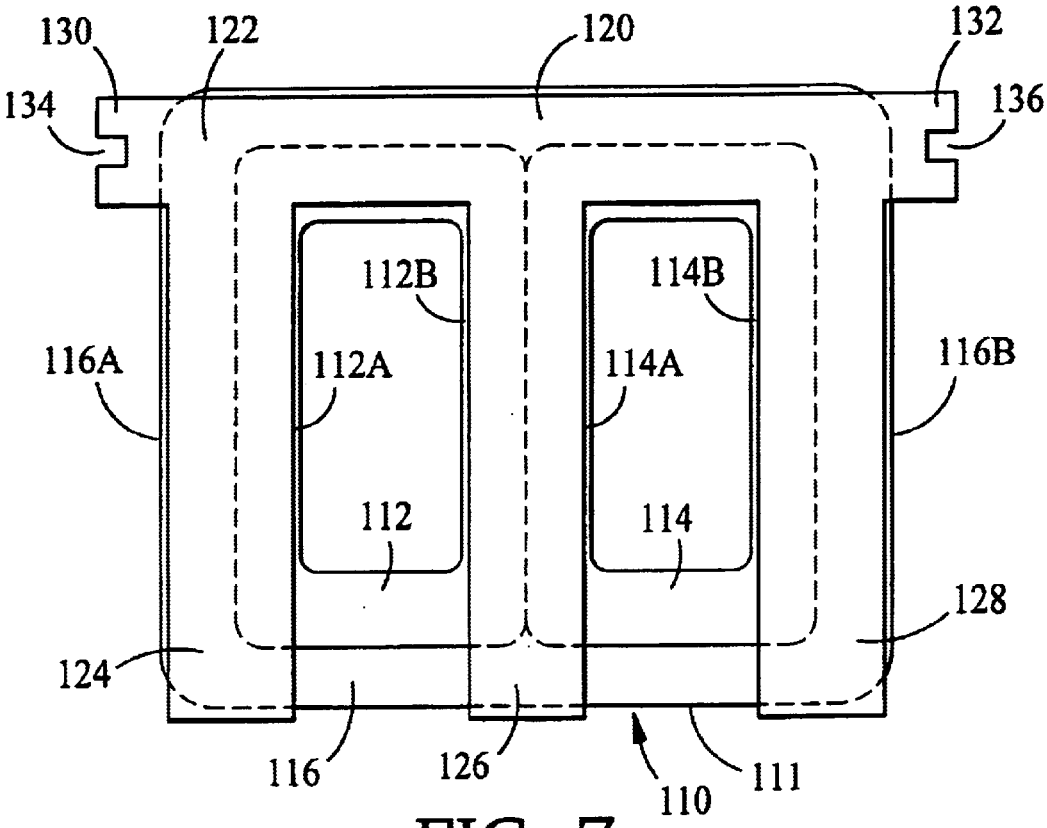
FIG. 7 illustrates a side view of a wound transformer core having three coils and three core limbs and a support assembly according to the invention.

FIG. 7 illustrates a side view of a further wound transformer core having three coils and three core limbs as well as a support assembly according to the invention. As shown, the transformer core 110 is comprised of a first inner coil 112, and a second inner coil 114 positioned with the interior of an outer coil 116. A first core limb is defined by core limb 116A of the outer coil 116 and core limb 112A of the first inner coil 112. A second core limb is defined by core limb 116B of the outer coil and core limb 114B of the second inner coil 114. An inner core limb is defined by the inner core limb 112B of the first inner coil 112 and the inner core limb 114A of the second inner coil 114. As can be further seen from FIG. 7, support assembly 120 is present, having a top section 122 and three dependent downwardly extending legs 124, 126 and 128 therefrom. As shown in this preferred embodiment the widths of the respective downwardly extending legs 124, 126 and 128 are lesser than the widths of the corresponding core limbs which they face. It is also seen that the lengths of these downwardly extending legs 124, 126 and 128 extends beyond the bottom outward face 111 of the transformer core 110 so that when the transformer core 110 and affixed to the support assembly 120 and positioned vertically, the combined weight of the transformer core 110 and support assembly 120 rests at the ends of the downwardly extending legs 124, 126 and 128. Additionally, the embodiment of the support assembly 120 includes two extended ends 130, 132 which may be included. Such extended ends 130, 132 may optionally include recesses 134, 136 which may be included in order to interlock or otherwise accommodate other elements of an assembled transformer of which the transformer core 110 and support assembly 120 forms a part. The recesses 134, 136 may take any form or configuration and are not limited to the generally square shaped recesses disclosed.

While not depicted in FIG. 7, it is nonetheless to be understood that there is present a similar support assembly 120 on the opposite side of the transformer core 110 and thus the transformer core 110 is positioned intermediate to these support assemblies. Such an arrangement is similar to that shown on FIG. 5, albeit with transformer core 110. Also, while not depicted on FIG. 7 it is to be understood that a suitable adhesive is layered intermediate at least portions of the transformer core 110 and the facing parts of the support assemblies 120.

The support assemblies according to the present invention are readily distinguishable from the plates depicted on the core segments in copending U.S. Ser. No. 08/918,194 in that in those segments, there are provided only discrete plates which do not have dependent leg portions therefrom. Furthermore these plates are generally only square or rectangular in configuration. As can be seen by mere inspection of those figures none of those plates are adapted to be adhered to separate and different portions of wound metal transformer cores. Rather, it is clear from those figures that while the discreet plates are useful in maintaining the structural integrity of the individual C-sections, I-sections and straight-sections. However these plates do not have any significant load bearing benefit or aid in relieving the strains or stresses which are imposed upon the assembled amorphous metal transformer cores when they are finally assembled.

The supports according to the present invention can be made of any suitable material which include magnetic materials such as ferrous materials, as well as non-magnetic materials and in particular include both non-reinforced, as well as reinforced polymer-based assemblies. With regard to ferrous materials, steels, irons, as well as alloys made therefrom, in a particular silicon steel (SiFe) can be utilized. The high strength of these metals are advantageous in providing good physical support characteristics which can be realized while at the same time minimizing the thickness of the support. With regard to polymer assemblies, these, of course, include materials which are sufficiently strong in order to provide the desired support to the amorphous metal transformer cores. These, of course, can include polymer materials which are essentially homogenous, as well as those which are reinforced such as by the inclusion of webs, meshes, strands, fibres, wovens and the like which are embedded within the polymer matrix. It is also desired that the polymer which may be used also exhibit a satisfactory degree of heat resistance and desirably are also fire retardant.

The supports can be affixed to the wound metal transformer cores by any of a variety of suitable means. Indeed, it is contemplated that any suitable means, device, or composition which can be used to affix support assemblies to transformer cores can be utilized. By way of non-limiting example, these include: one or more of a plurality of straps or bands encircling portions of the support assembly and the wound metal transformer core; a tape or web of a non-ferrous material such as a high strength cord, tape, ribbon or banding which is circularly wrapped or spirally wound about at least portions of the metal transformer core and the support assembly. Preferred however is the use of chemical bonding agents such as adhesives, particularly epoxy resins which can be used to provide a good adhesive joint between the amorphous metal transformer core and the support assembly.

One advantage of the inclusion of the perforations passing through the support assembly lies in the fact that when an adhesive such an epoxy resin is used to affix the support assembly to the sides of the amorphous metal transformer core, it is expect that some of the epoxy resin will flow into the interior of these perforations and thus, when hardened, provide a "stub" which not only ensure interfacial adhesion between the support assembly and the edge of the transformer core, but which also provide an interlocking physical joint between the interior walls of the perforations and the hardened resin. Further, these perforations, and the resulting interlocking relationship between the hardened resin and the perforations also admits for the possibility of using reduced amounts of resin while still providing good adhesive joints and the formation of stubs which also contribute to the secure anchoring of the joint assembly, particularly when the amorphous metal transformer core and support assembly are in a vertical or upright position as is typically expected to be found in power transformers.

The supports described herein are particularly advantageously used with wound metal cores which are fabricated from annealed amorphous metals, as the supports greatly improve the handling of the wound amorphous metal cores both prior to and especially subsequent to the annealing step, as well as reducing the stressing of the annealed amorphous metal core which is in great part due to its mass and geometry.

As to useful amorphous metals, generally stated, the amorphous metals suitable for use in the manufacture of wound, amorphous metal transformer cores can be any amorphous metal alloy which is at least 90% glassy, preferably at least 95% glassy, but most preferably is at least 98% glassy.

While a wide range of amorphous metal alloys may be used in the present invention, preferred alloys for use in amorphous metal transformer cores of the present invention are defined by the formula:

$$M_{70-85}Y_{5-20}Z_{0-20}$$

wherein the subscripts are in atom percent, "M" is at least one of Fe, Ni and Co. "Y" is at least one of B, C and P, and "Z" is at least one of Si, Al and Ge; with the proviso that (i) up to 10 atom percent of component "M" can be replaced with at least one of the metallic species Ti, V, Cr, Mn, Cu, Zr, Nb, Mo, Ta and W, and (ii) up to 10 atom percent of components (Y+Z) can be replaced by at least one of the non-metallic species In, Sn, Sb and Pb. Such amorphous metal transformer cores are suitable for use in voltage conversion and energy storage applications for distribution frequencies of about 50 and 60 Hz as well as frequencies ranging up to the gigahertz range.

By way of non-limiting example, devices for which the transformer cores of the present invention are especially suited include voltage, current and pulse transformers; inductors for linear power supplies; switch mode power supplies; linear accelerators; power factor correction devices; automotive ignition coils; lamp ballasts; filters for EMI and RFI applications; magnetic amplifiers for switch mode power supplies; magnetic pulse compression devices, and the like. The transformer cores of the present invention may be used in devices having power ranges starting from about 5 kVA to about 50 MVA, preferably 200 kVA to 10 MVA. According to certain preferred embodiments, the transformer cores find use in large size transformers, such as power transformers, liquid-filled transformers, dry-type transformers, and the like, having operating ranges most preferably in the range of 200 KVA to 10 MVA. According to certain further preferred embodiments, the transformer cores according to the invention are wound amorphous metal transformer cores which have masses of at least 200 kg, preferably have masses of at least 300 kg, still more preferably have masses of at least 1000 kg, yet more preferably have masses of at least 2000 kg, and most preferably have masses in the range of about 2000 kg to about 25000 kg.

The application of the invention where the transformer cores are produced of amorphous metal alloys derive a great benefit from the present invention. As such amorphous metal alloys are typically only available in thin strips, ribbons or sheets ("plates") having a thickness generally not in excess of twenty five thousandths of an inch. These thin dimensions necessitate a greater number of individual laminar layers in an amorphous metal core and substantially complicates the assembly process, particularly when compared to transformer cores fabricated from silicon steel, which is typically approximately ten times thicker in similar application. Additionally, as will be appreciated to skilled practitioners in the art, subsequent to annealing, amorphous metals become substantially more brittle than in their unannealed state and mimic their glassy nature when stressed of flexed by easily fracturing. Due to the lack of long range crystalline order in annealed amorphous metals, the direction of breakage is also highly unpredictable and unlike more crystalline metals which can be expected to break along a fatigue line or point, an annealed amorphous metal frequently breaks into a multiplicity of parts, including troublesome flakes which are very deleterious as discussed herein.

Certain of the assembly steps required to manufacture the transformer cores according to the present invention include conventional techniques which may be known to the art, or may be described in either U.S. Ser. No. 08/918,194 or U.S. Ser. No. 09/841,944 the contents of which are herein incorporated by reference. Generally, in order to manufacture a transformer core from a continuous ribbon or strip of an amorphous metal, prior to any annealing step the cutting and stacking of laminated group and packets is carried out with a cut-to-length machine and stacking equipment capable of positioning and arranging the groups in the step-lap joint fashion. The cutting length increment is determined by the thickness of lamination grouping, the number of groups in each packet, and the required step lap spacing. Thereafter the cores, or core segments may be shaped according to known techniques, such as bending the laminated groups or packets about a form such as a suitably dimensioned mandrel. Alternately the cores may also be produced utilizing a semi-automatic belt-nesting machine which feeds and wraps individual groups and packets onto a rotating arbor or manual pressing and forming of the core lamination from an annulus shape into the rectangular core shape.

It is clearly contemplated that while the invention discussed hererin although generally described with reference to transformer cores which are wound upon a mandrel, that the same inventive teaching may be advantageously applied to non-wound transformer cores. Such include cores which are build up of a series of precut strips or other forms which are not wound, but rather are stacked or layered in register in order to constitute a transformer core.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

What is claimed is:

1. A support assembly adapted to be attached to two intersecting sections of an metal transformer core, wherein the support assembly includes at least a top section and at least one dependent leg section, and wherein the said top section is adapted to be affixed to one of the intersecting sections of the metal transformer core, and the at least one dependent leg section is adapted to be affixed to the other section of the metal transformer core.

2. The support assembly according to claim 1 wherein the metal transformer core is a wound core formed of an annealed amorphous metal alloy.

3. The support assembly according to claim 2 which comprises at least three sections; a top section and at least two dependent leg sections, said leg sections being both generally perpendicular to the top section, and generally parallel to one another.

4. The support assembly according to claim 3 wherein one dependent leg section is adapted to be affixed to a first leg of the metal transformer core, the other dependent leg section is adapted to be affixed to at least a second leg of the metal transformer core.

5. The support assembly according to claim 3 wherein the metal transformer core is a wound core formed of an annealed amorphous metal alloy.

6. The transformer comprising a wound or laminated metal transformer core and a support assembly according to claim 1.

* * * * *